US010918217B2

(12) United States Patent
Fuerstenberg

(10) Patent No.: US 10,918,217 B2
(45) Date of Patent: Feb. 16, 2021

(54) PILLOW SUPPORT ASSEMBLY

(71) Applicant: Glenn Fuerstenberg, Sioux Falls, SD (US)

(72) Inventor: Glenn Fuerstenberg, Sioux Falls, SD (US)

( * ) Notice: Subject to any disclaimer, the term of this patent is extended or adjusted under 35 U.S.C. 154(b) by 0 days.

(21) Appl. No.: 16/392,840

(22) Filed: Apr. 24, 2019

(65) Prior Publication Data

US 2020/0337469 A1 Oct. 29, 2020

(51) Int. Cl.
*A47C 20/02* (2006.01)
*A47C 20/04* (2006.01)

(52) U.S. Cl.
CPC ..... *A47C 20/02* (2013.01); *A47C 20/04* (2013.01)

(58) Field of Classification Search
CPC ..... A47C 20/02; A47C 20/04; A47C 20/021; A47C 16/00; A47C 16/005; A47C 16/025; A47C 20/027; A47G 9/1009; A61G 7/07; A61G 7/072; A61G 7/0755
See application file for complete search history.

(56) References Cited

U.S. PATENT DOCUMENTS 3,757,364 A 9/1973 Downing
3,981,032 A 9/1976 Brooks
5,360,017 A 11/1994 Austin
6,012,186 A * 1/2000 Soltani ..... A47C 20/048 5/613
6,159,169 A 12/2000 Lambden
6,671,906 B1 1/2004 Milligan
7,788,750 B2 9/2010 Norstrem
9,032,961 B2 5/2015 Zhang
9,095,231 B2 8/2015 Abdo
9,516,959 B2 12/2016 Noh
9,775,451 B1 10/2017 Chon
9,795,232 B2 10/2017 Holbrook
9,955,805 B2 5/2018 Lou
2006/0169691 A1* 8/2006 Rothschild ..... A45C 13/1038 220/7
2011/0056502 A1* 3/2011 Davis ..... A61G 13/1265 128/845
2014/0265486 A1* 9/2014 Connors ..... A47C 20/04 297/250.1
2015/0150391 A1* 6/2015 Hsu ..... A47C 7/383 5/636
2015/0190304 A1* 7/2015 Lawrie ..... A61H 15/00 601/118
2015/0238018 A1* 8/2015 Backer ..... A47C 7/46 5/640

(Continued)

*Primary Examiner* — Nicholas F Polito
*Assistant Examiner* — George Sun

(57) ABSTRACT

A pillow support assembly includes panel that has a top side, a bottom side, and a perimeter edge. The perimeter edge includes a first edge and a second edge positioned opposite of each other. The panel includes a first portion including the first edge and a second portion including second edge. The top side of the second portion is formable into a concave shape from the first portion to the second edge and the second portion is pivotable over the first portion when the second portion is in the concave shape. A securing member releasably secures the second portion in an arced condition extending over the first portion. The bottom side of the second portion supports a pillow when the second portion is in the arced condition.

15 Claims, 6 Drawing Sheets

(56) References Cited

U.S. PATENT DOCUMENTS

| | | | | |
|---|---|---|---|---|
| 2015/0238036 | A1* | 8/2015 | Robbins, III | A47C 7/18 428/101 |
| 2016/0037936 | A1* | 2/2016 | Nomura | A47C 20/08 5/618 |
| 2018/0140101 | A1* | 5/2018 | Davis | A47C 27/065 |
| 2018/0289183 | A1* | 10/2018 | Karl | A47G 9/1009 |
| 2020/0154899 | A1* | 5/2020 | Brown | A47C 20/041 |

* cited by examiner

PILLOW SUPPORT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The device of the current disclosure concerns devices used for supporting a person's neck while they are lying down such as on a mattress but may also be used during periods of rest and relaxation such as on a reclining chair.

(2) Description of Related Art Including Information Disclosed Under 37 CFR 1.97 and 1.98

The disclosure and prior art relates to pillow shape retention devices and more particularly pertains to a new pillow shape retention device for positioning under a pillow such that the pillow better supports the neck and head of a person

BRIEF SUMMARY OF THE INVENTION

An embodiment of the disclosure meets the needs presented above by generally comprising a panel that has a top side, a bottom side, and a perimeter edge. The perimeter edge includes a first edge, a second edge, a third edge and a fourth edge. The first and second edges are positioned opposite of each other. The panel includes a first portion including the first edge and a second portion including second edge. The panel has a length dimension from the first edge to the second edge and the first portion extends from the first edge a distance equal to between 30% and 70% of the length dimension. The top side of the second portion is formable into a concave shape from the first portion to the second edge and the second portion is pivotable over the first portion when the second portion is in the concave shape. A securing member releasably secures the second portion in an arced condition extending over the first portion. The bottom side of the second portion supports a pillow when the second portion is in the arced condition.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
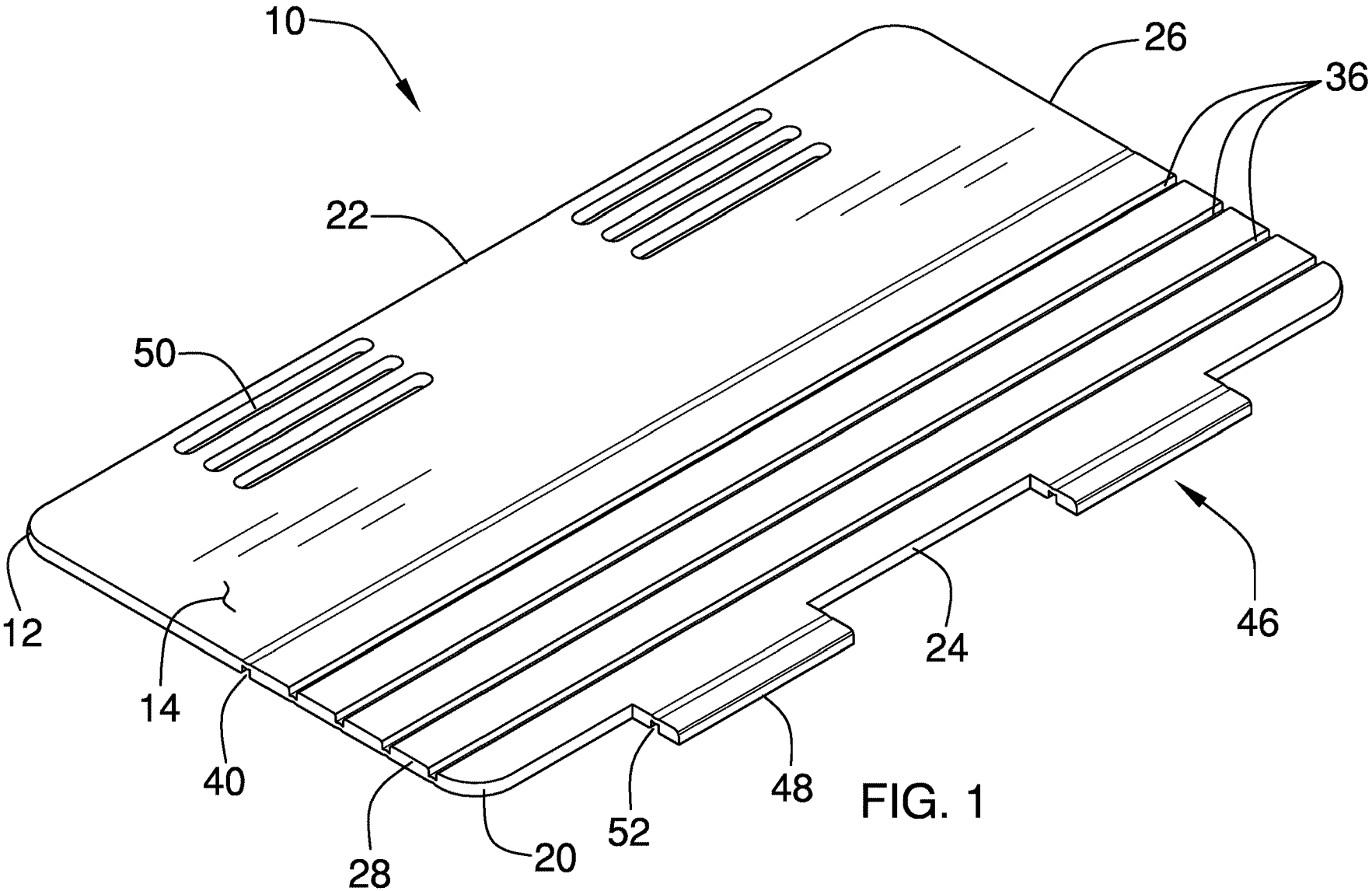
FIG. 1 is a top isometric view of a pillow support assembly according to an embodiment of the disclosure.

With reference now to the drawings, and in particular to FIGS. 1 through 6 thereof, a new pillow shape retention device embodying the principles and concepts of an embodiment of the disclosure and generally designated by the reference numeral 10 will be described.

As best illustrated in FIGS. 1 through 6, the pillow support assembly 10 generally comprises a panel 12 that has a top side 14, a bottom side 16, and a perimeter edge 18. The perimeter edge 20 includes a first edge 22, a second edge 24, a third edge 26 and a fourth edge 28. The first 22 and second 24 edges are positioned opposite of each other. The panel 12 includes a first portion 30 including the first edge 22 and a second portion 32 including second edge 24. The panel 12 has a length dimension from the first edge 20 to the second edge 30 and the first portion 30 extends from the first edge 22 a distance equal to between 30% and 70% of the length dimension. The panel 12 is comprised of a resiliently bendable material which may include, for example, a plastic material. The panel 12 will typically have a thickness of between 0.20 inches and 0.40 inches and thus will be slightly bendable however after being bent the panel 12 would return to its original, planar condition and would generally be considered rigid for the intended use purposes described herein. The length dimension is between 7.0 inches and 14.0 inches and the panel 12 has a width dimension that is at least 12.0 inches and typically up to 24.0 inches. However, the width dimension may be as great as 72.0 should the device be used to extend fully across a bed. Typically the width dimension will be 19.0 inches to match the width of a conventional standard pillow 34 used for sleeping.

Figure 6:
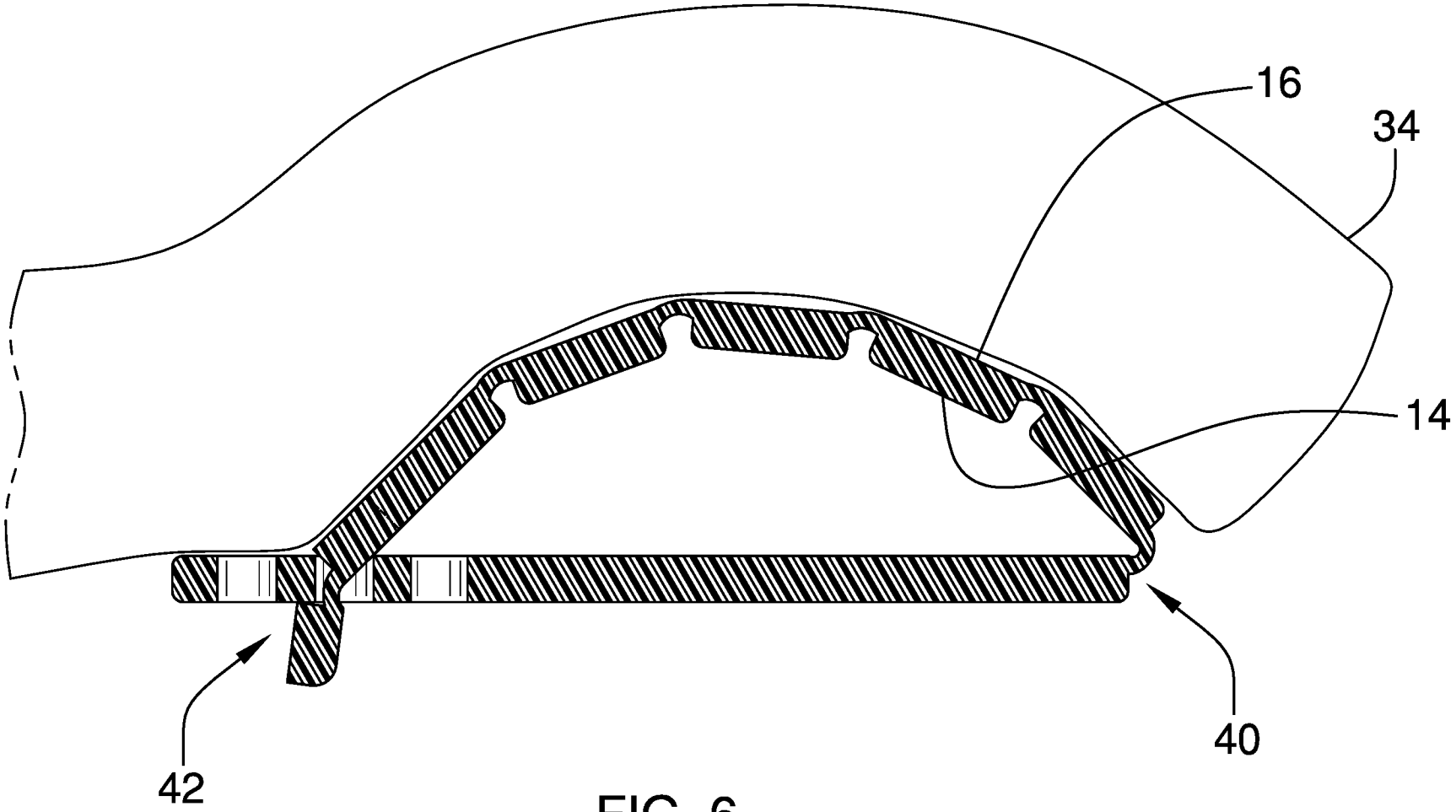
FIG. 6 is a cross-sectional view of an embodiment of the disclosure taken along line 6-6 of FIG. 2.

The top side 14 of the second portion 32 of the panel 12 has a plurality of flexible joints 36 therein extending between and through the third 26 and fourth 28 edges. The second edge 24 is straight and the flexible joints 36 are orientated parallel to each other and the second edge. The flexible joints 36 are equally spaced from each other and will most often comprise at least three of the flexible joints 36. The flexible joints 36 facilitate the top side 16 of the second portion 32 being formed into a concave shape from the first portion 30 to the second edge 24 and having an adjustable height between 2.0 inches and 5.0 inches. Each of the flexible joints 36 may be formed from any conventional joint or hinge construction though one particular structure may include elongated troughs such that the flexible joints 36 each comprise a living hinge. The plastic material of the panel 12 will urge panel sections 38, positioned between the flexible joints 36, away from each other to retain the second portion 32 in the domed, arcuate shape as shown in FIG. 6.

The bottom side 16 of the panel 12 has a pivoting joint 40 therein extending between and through the third 26 and fourth 28 edges. The pivoting joint 40 is positioned between the first edge 22 and the flexible joints 36 and defines a boundary between the first 30 and second 32 portions. The pivoting joint 40 facilitates positioning the second portion 32 over the top side 14 of the first portion 30. The pivoting joint 40 may be formed from a conventional joint or hinge but it may be preferred to form a channel in the bottom side 16 of the panel 12 such that the pivoting joint 40 comprises a living hinge.

A securing member 42 releasably secures the second portion 32 in an arced condition extending over the first portion 30. The securing member 42 includes a first mating member 44 and a second mating member 46 releasably engageable with each other. The first mating member 44 is positioned on the first portion 30 and the second mating member 46 is positioned on the second portion 32. The second mating member 46 comprises a catch 48 attached to the second edge 24 and the first mating member 44 comprises a notch 50 for receiving the second mating member 46. As can be seen in FIG. 6, an indent 52 may be formed in the catch 48 such that indent 52 engages the panel 12 as the catch 48 is extended into the notch 50. Furthermore, the notch 50 may comprise an opening extending completely through the panel 12. This allows the catch 48 to form an extension extending through the notch 50 and beyond the bottom side 16 of the first portion 30 so that it may frictionally engage a mattress or cushion below the assembly 10 to prevent the assembly 10 from moving during use.

The first mating member 44 may include a plurality of notches 50 that are spaced from each other along a line extending from the first edge 22 to the second edge 24. This allows the user to select which notch 50 to utilize, which in turn will alter the height of resultant dome formed by the second portion 32. The first mating member 44 therefore may include at least three of the notches 50 positioned in a row extending away from the first edge 22. As can be seen in the Figures, the securing member 42 may comprise a pair of securing members 42 each including a catch 48 and a plurality of notches 50.

Figure 2:
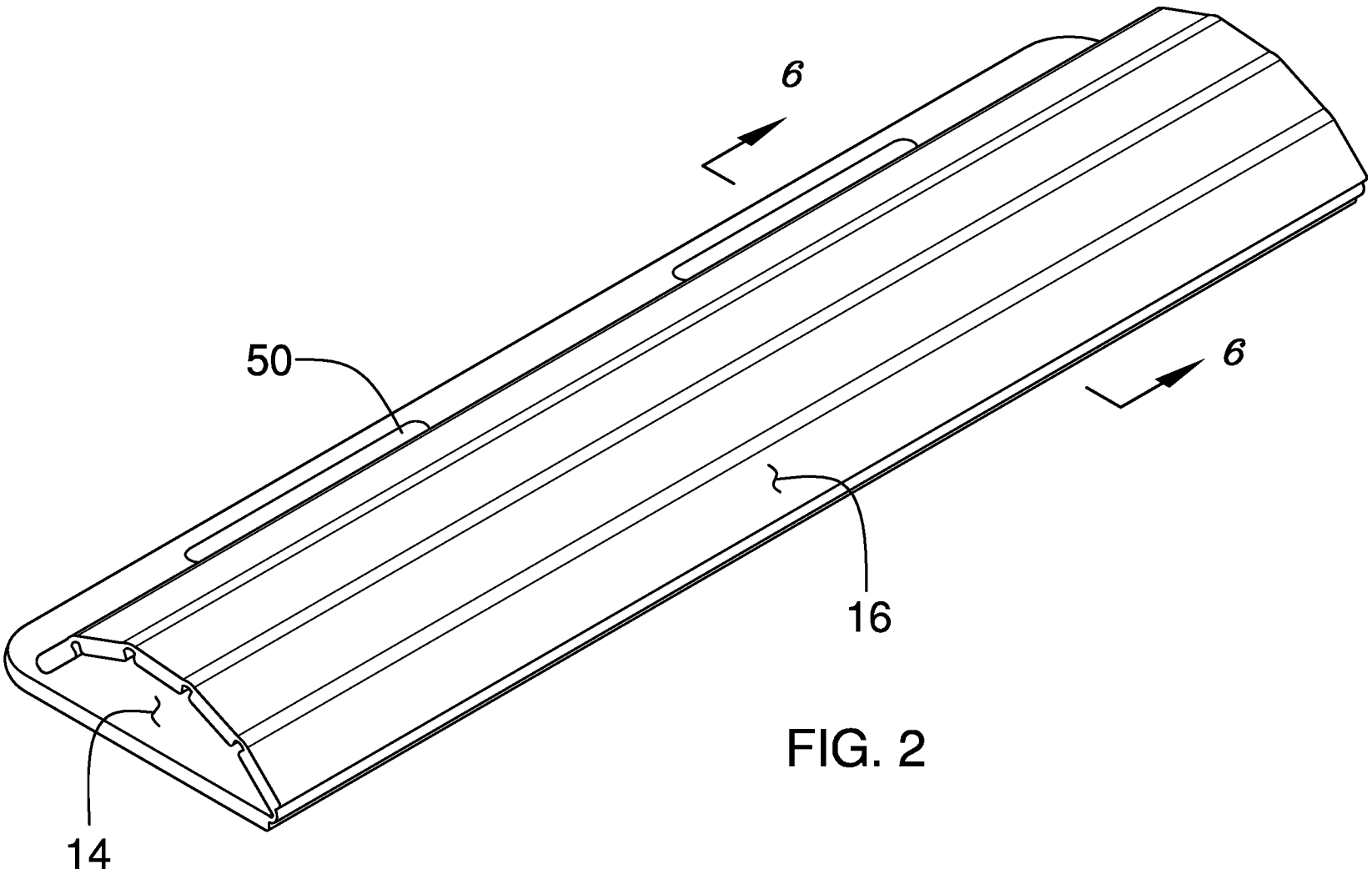
FIG. 2 is a top isometric view of an embodiment of the disclosure.
Figure 3:
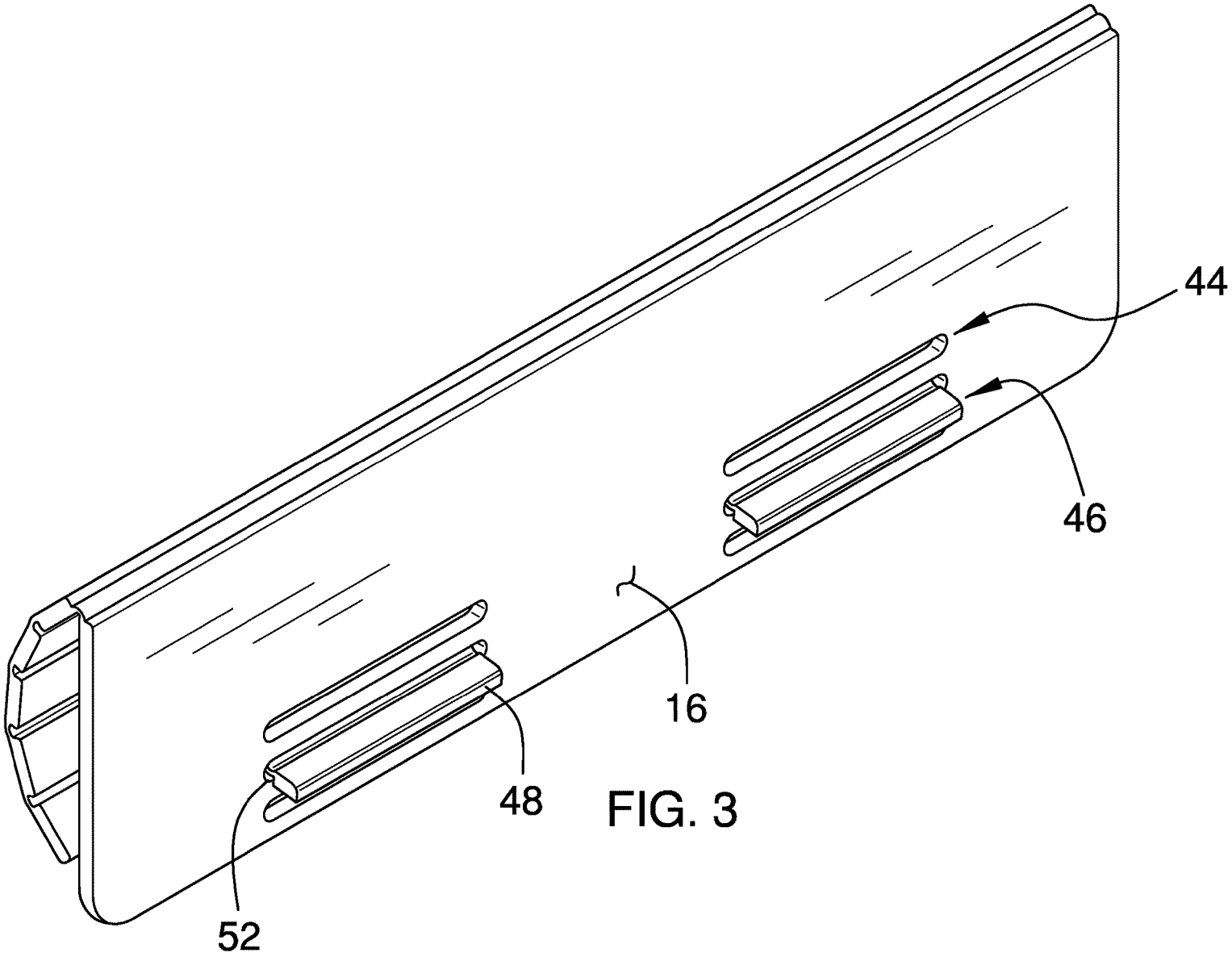
FIG. 3 is a bottom isometric view of an embodiment of the disclosure.
Figure 4:
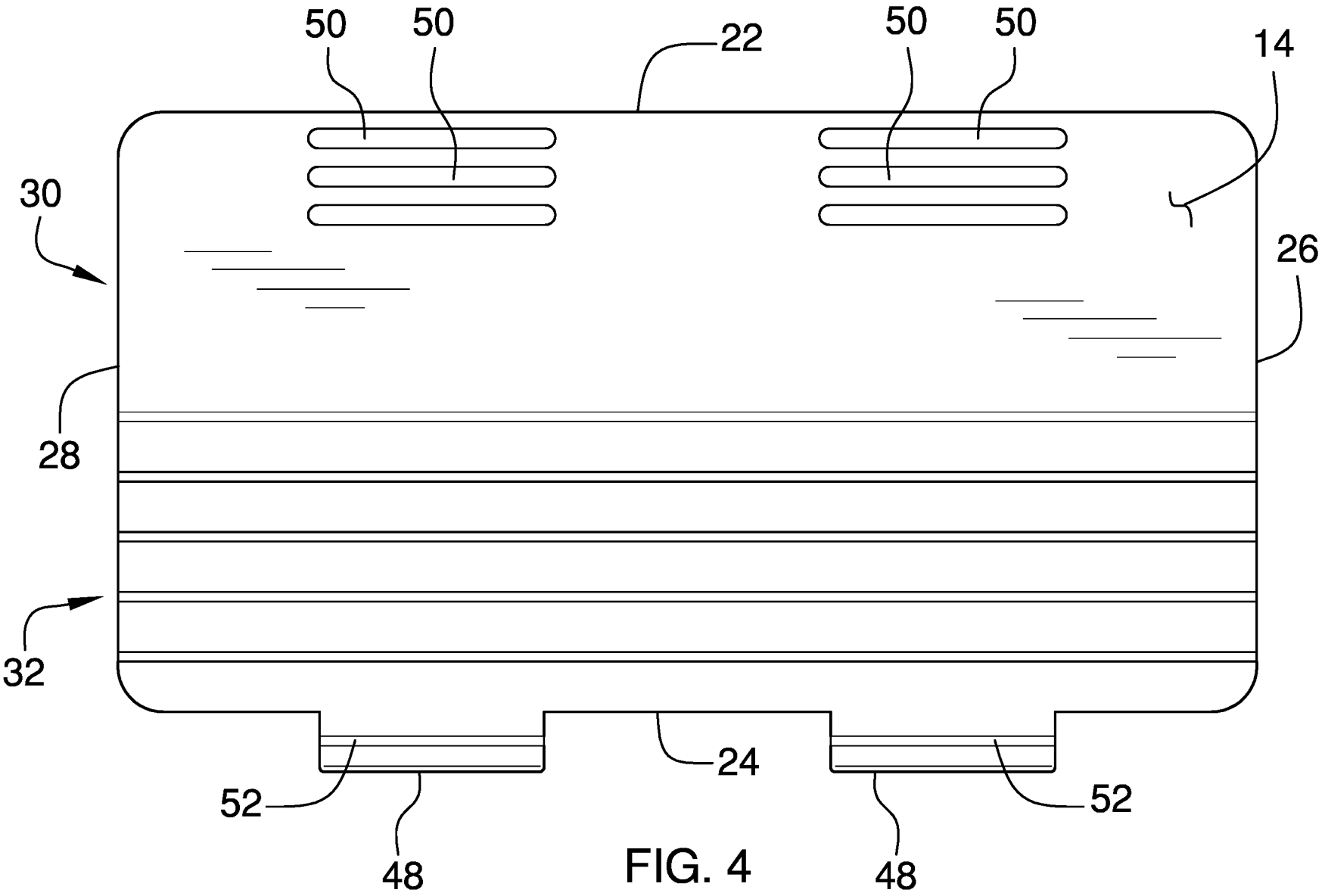
FIG. 4 is a top view of an embodiment of the disclosure.
Figure 5:
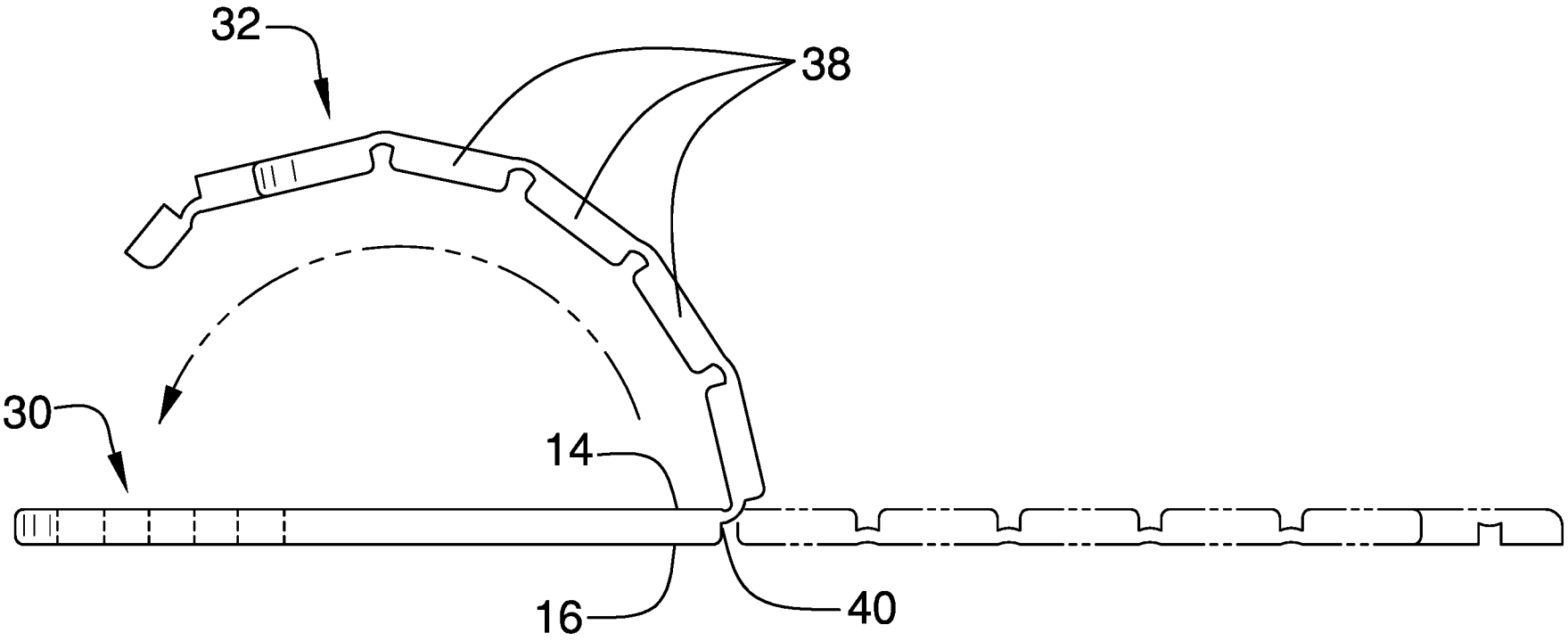
FIG. 5 is a side view of an embodiment of the disclosure.

In use, the user of the assembly 10 will arc the second portion 32 over the first portion 30 as shown in FIG. 5 and secure it in the selected one of the notches 50. As can be seen in FIG. 2, this will face the bottom side 16 of the second portion 32 upwardly so that it is configured to support the pillow 34 when the second portion 32 is in the arced condition. The pillow 34 is placed over the assembly 10 and the user utilizes the pillow 34 in a conventional manner. However, the assembly 10 will be placed under the neck of the user and will maintain a comfortable arced support in the pillow 34, because, unlike the pillow 34, the assembly 10 will not collapse under the weight of the person's head. In addition to maintaining neck and head support for the user, the assembly 10 will allow air to move under the pillow 34 to prevent accumulation of heat and thereby create a cooling effect.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A pillow support assembly configured for positioning under a pillow to support a neck and head of a user of the assembly, the assembly comprising:

a panel having a top side, a bottom side, and a perimeter edge, the perimeter edge including a first edge, a second edge, a third edge and a fourth edge, the first and second edges being positioned opposite of each other, the panel including a first portion including the first edge and a second portion including second edge, the panel having a length dimension from the first edge to the second edge, the first portion extending from the first edge a distance equal to between 30% and 70% of the length dimension;

the top side of the second portion being formable into a concave shape from the first portion to the second edge, the second portion being pivotable over the first portion when the second portion is in the concave shape;

a securing member releasably securing the second portion in an arced condition extending over the first portion;

wherein the bottom side of the second portion is configured to support a pillow when the second portion is in the arced condition;

wherein the securing member includes a first mating member and a second mating member releasably engageable with each other, the first mating member being positioned on the first portion and the second mating member being positioned on the second portion;

wherein the second mating member comprises a catch attached to the second edge, the first mating member comprising a notch for receiving the second mating member; and wherein the first mating member comprises a plurality of notches, the plurality of notches being spaced from each other along a line extending from the first edge to the second edge, the first mating member including at least three of the notches positioned in a row extending away from the first edge.

2. The pillow support assembly according to claim 1, wherein the top side of the second portion of the panel has a plurality of flexible joints therein extending between and through the third and fourth edges to facilitate positioning the second portion in the arced condition.

3. The pillow support assembly according to claim 2, wherein the second edge is straight and the flexible joints are orientated parallel to each other and the second edge, the flexible joints are equally spaced from each other and comprise at least three of the flexible joints.

4. The pillow support assembly according to claim 3, wherein each of the flexible joints comprises a living hinge.

5. The pillow support assembly according to claim 4, wherein the bottom side of the panel has a pivoting joint therein extending between and through the third and fourth edges to facilitate the pivoting of the second portion over the first portion.

6. The pillow support assembly according to claim 5, wherein the pivoting joint is positioned between the first edge and the flexible joints, the pivoting joint defining a boundary between the first and second portions.

7. The pillow support assembly according to claim 6, wherein the pivoting joint comprises a living hinge.

8. The pillow support assembly according to claim 1, wherein the bottom side of the panel has a pivoting joint therein extending between and through the third and fourth edges to facilitate the pivoting of the second portion over the first portion.

9. The pillow support assembly according to claim 8, wherein the pivoting joint is positioned between the first edge and the flexible joints, the pivoting joint defining a boundary between the first and second portions.

10. The pillow support assembly according to claim 9, wherein the pivoting joint comprises a living hinge.

11. The pillow support assembly according to claim 1, wherein:

the top side of the second portion of the panel has a plurality of flexible joints therein extending between and through the third and fourth edges to facilitate positioning the second portion in the arced condition; and the bottom side of the panel has a pivoting joint therein extending between and through the third and fourth edges to facilitate the pivoting of the second portion over the first portion.

12. The pillow support assembly according to claim 11, wherein the panel being comprised of a resiliently bendable material, the panel being comprised of a plastic material, the length dimension being between 7.0 inches and 14.0 inches, the panel having a width dimension being at least 12.0 inches.

13. The pillow support assembly according to claim 1, wherein the panel being comprised of a resiliently bendable material, the panel being comprised of a plastic material, the length dimension being between 7.0 inches and 14.0 inches, the panel having a width dimension being between 15.0 inches and 24.0 inches.

14. A pillow support assembly configured for positioning under a pillow to support a neck and head of a user of the assembly, the assembly comprising:

a panel having a top side, a bottom side, and a perimeter edge, the perimeter edge including a first edge, a second edge, a third edge and a fourth edge, the first and second edges being positioned opposite of each other, the panel including a first portion including the first edge and a second portion including second edge, the panel having a length dimension from the first edge to the second edge, the first portion extending from the first edge a distance equal to between 30% and 70% of the length dimension;

the top side of the second portion being formable into a concave shape from the first portion to the second edge, the second portion being pivotable over the first portion when the second portion is in the concave shape;

a securing member releasably securing the second portion in an arced condition extending over the first portion;

wherein the bottom side of the second portion is configured to support a pillow when the second portion is in the arced condition;

the top side of the second portion of the panel having a plurality of flexible joints therein extending between and through the third and fourth edges to facilitate positioning the second portion in the arced condition; and the bottom side of the panel having a pivoting joint therein extending between and through the third and fourth edges to facilitate the pivoting of the second portion over the first portion;

wherein the second mating member comprises a catch attached to the second edge, the first mating member comprising a notch for receiving the second mating member; and wherein the first mating member comprises a plurality of notches, the plurality of notches being spaced from each other along a line extending from the first edge to the second edge, the first mating member including at least three of the notches positioned in a row extending away from the first edge.

15. A pillow support assembly configured for positioning under a pillow to support a neck and head of a user of the assembly, the assembly comprising:

a panel having a top side, a bottom side, and a perimeter edge, the perimeter edge including a first edge, a second edge, a third edge and a fourth edge, the first and second edges being positioned opposite of each other, the panel including a first portion including the first edge and a second portion including second edge, the panel having a length dimension from the first edge to the second edge, the first portion extending from the first edge a distance equal to between 30% and 70% of the length dimension;

the top side of the second portion of the panel having a plurality of flexible joints therein extending between and through the third and fourth edges, the second edge being straight and the flexible joints being orientated parallel to each other and the second edge, the flexible joints being equally spaced from each other, the plurality of the flexible joints comprising at least three of the flexible joints, the flexible joints facilitating the top side of the second portion being formed into a concave shape from the first portion to the second edge, each of the flexible joints comprising a living hinge;

the bottom side of the panel having a pivoting joint therein extending between and through the third and fourth edges, the pivoting joint being positioned between the first edge and the flexible joints, the pivoting joint defining a boundary between the first and second portions, the pivoting joint facilitating positioning the second portion over the top side of the first portion, the pivoting joint comprising a living hinge;

a securing member releasably securing the second portion in an arced condition extending over the first portion, the securing member including a first mating member and a second mating member releasably engageable with each other, the first mating member being positioned on the first portion and the second mating member being positioned on the second portion, the second mating member comprising a catch attached to the second edge, the first mating member comprising a notch for receiving the second mating member, the first mating member comprising a plurality of notches, the plurality of notches being spaced from each other along a line extending from the first edge to the second edge, the first mating member including at least three of the notches positioned in a row extending away from the first edge;

the panel being comprised of a resiliently bendable material, the panel being comprised of a plastic material, the length dimension being between 7.0 inches and 14.0 inches, the panel having a width dimension being at least equal to 15.0 inches; and wherein the bottom side of the second portion is configured to support a pillow when the second portion is in the arced condition.

* * * * *